US008128089B2

(12) United States Patent
Erickson

(10) Patent No.: US 8,128,089 B2
(45) Date of Patent: Mar. 6, 2012

(54) AUTOMATED BINGO GAME BASED ON RFID-TAGGED BALLS

(76) Inventor: Bertil Ronald Erickson, Union, NJ (US)

( * ) Notice: Subject to any disclaimer, the term of this patent is extended or adjusted under 35 U.S.C. 154(b) by 12 days.

(21) Appl. No.: 12/850,781

(22) Filed: Aug. 5, 2010

(65) Prior Publication Data

US 2012/0032396 A1 Feb. 9, 2012

(51) Int. Cl.
*A63F 3/06* (2006.01)

(52) U.S. Cl. ..... 273/144 A; 273/144 R; 273/269; 273/138.2; 463/17; 463/19

(58) Field of Classification Search ..... 273/144 R, 273/144 A, 144 B, 269, 138.2; 463/17, 19
See application file for complete search history.

(56) References Cited

U.S. PATENT DOCUMENTS

| | | | | |
|---|---|---|---|---|
| 5,799,940 | A * | 9/1998 | Tripp | 273/144 R |
| 2004/0048659 | A1* | 3/2004 | Seelig et al. | 463/25 |
| 2006/0003833 | A1* | 1/2006 | Seelig et al. | 463/25 |
| 2006/0046837 | A1* | 3/2006 | Ito et al. | 463/22 |

OTHER PUBLICATIONS http://www.bingomaker.net, accessed May 12, 2010, "Quotation of Lottery RFID Tag Balls".

* cited by examiner

*Primary Examiner* — Benjamin Layno

(74) *Attorney, Agent, or Firm* — Michael J. Feigin, Esq.; http://PatentLawNY.com

(57) ABSTRACT

Embodiments of the disclosed technology provide a method of integrating radio frequency identification (RFID) and near field communication (NFC) to add excitement, features, automation or semi-automation, and digital connectivity to a traditional Bingo or lottery game. Any game of chance may be played using embodiments of the disclosed technology. Balls used for purposes of randomization comprise freely movable RFID tags situated therein. When a ball is chosen, such as when it is the first or only ball to pass through an exit tube of a mixing apparatus, its RFID tag (with data corresponding to indicia on the ball) is read, and appropriate action can be taken, such as to update a video screen accordingly, check Bingos, check lottery winning tickets, and so forth.

19 Claims, 8 Drawing Sheets

AUTOMATED BINGO GAME BASED ON RFID-TAGGED BALLS

FIELD OF THE DISCLOSED TECHNOLOGY

The disclosed technology relates generally to radio frequency identification tagging. More specifically, the disclosed technology relates to a Bingo game using radio frequency identification tagging.

BACKGROUND OF THE DISCLOSED TECHNOLOGY

Bingo is a game of chance played with randomly drawn numbers using Bingo balls. Players match numbers drawn to pre-printed 5"×5" matrices. The matrices may be printed on paper, card stock, or electrometrically represented and are referred to as cards. In many versions, the game is concluded when a first person achieves a specified pattern on his or her card. The winner is usually required to call out the word "Bingo" to alert other players and the caller of a possible win. All wins are checked for accuracy by having a "floor person" call out the numbers marked on the card, while another manually checks the number against the drawn balls. Once verified, the win is officially confirmed, a prize is handed out, and a new game begins. In such a version of Bingo, players compete against each other for the prize or jackpot.

Alternative methods of play have been developed to increase participation and create excitement. Since the invention of Bingo in 1934, multiple variations, abiding by each jurisdiction's gambling laws, have been created. Such variations include an almost limitless number of patterns specified for play. For example, only one number may need to be matched, the entire card may need to be covered, or the last player to fail to match a specified pattern may be deemed the winner.

Most commonly, Bingo cards are flat pieces of disposable paper which contain 25 squares arranged in five vertical columns and five horizontal rows. Typically, the game is played utilizing 75 numbers. The letters BINGO are pre-printed above the five vertical columns, with one letter appearing above each column. The center space is usually marked "Free" and is given to each player at the start of the game. The printed numbers on the card commonly correspond to numbers as follows: 1 to 15 in the B column, 16 to 30 in the I column, 31 to 45 in the N column, 46 to 60 in the G column, and 61 to 75 in the O column.

While almost every child in the United States has played Bingo at some time, in some settings the stakes are high and the regulations are strict. A large number of Bingo halls are rented out to sponsoring organizations, and churches and charity organizations often run Bingo games. Several random number generation methods are used to draw numbers in the Bingo game. Most states require a mechanical ball drawing mechanism which uses a ball blower that mixes ping pong balls with blown air or a cage which is turned to mix the balls. The balls must be of equal size, shape, and weight distribution to ensure the most random drawing possible.

As described above, the prior art Bingo game has remained essentially unmodified since the 1930s. It is a largely manual system which may have a fair amount of down time. Every time a person calls "Bingo!" a fact checker must run through the numbers drawn and the numbers on the card to check for a Bingo. Likewise, a person must physically pull out each ball as it's drawn and place it into a hopper, arranged by ball number, so that when the fact checking time comes, the ball's drawing can be verified.

What is needed in the art of Bingo games is a way to add more excitement to the game. What is further needed is a method of decreasing down time and providing faster action. Still further, there is a need for a method of increasing accuracy and decreasing the possibility of a game to be fixed or cheated.

SUMMARY OF THE DISCLOSED TECHNOLOGY

The disclosed technology described herein addresses the needs of the prior art to revitalize and add excitement to the game of Bingo, or any other game which uses random drawings of balls (such as state lotteries) by adding automated number checking.

It is an object of the disclosed technology to provide RFID (radio frequency identification tags) in each ball and provide an RFID reader positioned near the RFID tag, as a ball exits a blower or rotating ball mixer.

It is a further object of the disclosed technology to provide an automated bingo or lottery system. In embodiments of the disclosed technology, such an automated system may be used to automate some or all of the bingo processes carried out by those who run or those who play the game, and some or all of the processes may occur remotely.

It is yet a further object of the disclosed technology to provide digital outputs, such as on a television monitor, of balls drawn or winning cards.

An embodiment of the disclosed technology is a randomized ball selector. Such a ball selector uses a video screen (integrated or a separate screen used via direct cable, internet, or television linkage, whether used solely for this purpose or also for other purposes, such as television broadcasts, and may be at the location of the selector or distant, such as a mile or more away). The ball selector has a chamber with an exit tube and a plurality of balls (two or more) housed within the chamber. Each ball has a radio frequency identification tag with unique indicia stored thereon. A mixing apparatus, adapted for mixing a plurality of balls within the chamber is employed, as well as a near field communication reader in the exit tube. Upon the exit of a single ball of the plurality of balls into the exit tube, the near field communication reader reads the unique indicia of the single ball, and the video screen exhibits a display corresponding to the unique indicia of the single ball. The radio frequency identification tag of each ball in the plurality of balls may move freely within each ball.

The mixing apparatus may be a blower. In such a case, the exit tube extends above the chamber, in some embodiments, with the near field communication reader situated below the exit tube. The radio frequency identification tag of the single ball drops to a bottom of the single ball in the exit tube where it is easily read by the near field communication reader. In other embodiments, the mixing apparatus mixes by way of rotation of the chamber.

The randomized ball selector may used for a game of Bingo or state lottery (or any other lottery game). When used for Bingo, the near field communication reader may read a plurality of unique indicia, the unique indicia may be electrically stored on a memory storage device, and upon a player of the Bingo game declaring a win, indicia corresponding to a game card of the player may be inputted into a computer device. The computer device may exhibit indicia on the video screen confirming a win when the memory storage device comprises the inputted indicia. The inputted indicia may correspond to a game card's unique identifier, and a win is determined based on the unique identifier of the game card and the unique indicia. The inputting may be by way of manual input, near field communication, transmission over a packet-switched network, or the like. If by manual input, it may be done by an operator of the Bingo game.

A plurality of balls, usable for a ball selector, is also described herein. Each ball of the plurality of balls comprises a generally spherical encasement with a hollow interior, human-readable indicia on said spherical encasement, and a radio frequency identification tag freely movable in it's housing within the hollow interior and adapted to transmit data corresponding to the human-readable indicia. The radio frequency identification tag, in embodiments of the disclosed technology, is freely movable within said hollow interior and drops to the gravitational bottom of the hollow interior when the ball is stationary.

The ball selector may have a near field communication reader below an exit tube and above a resting location adapted for stationary holding of a ball of the plurality of balls. Once the near field communication reader has read the indicia stored in the radio frequency identification tag of a/the ball, the human-readable indicia are displayed on a video screen, in embodiments of the disclosed technology.

A method of playing a game of chance is also disclosed. The method proceeds as follows. A plurality of balls is placed within a chamber of a mixing apparatus, each ball having a hollow interior with freely moving radio frequency identification tag therein. While mixing the plurality of balls in the chamber, an exit is opened into an exit tube until at least a first ball of the plurality of balls exits through the tube. Data from a said radio frequency identification tag of the first ball is read, and human-readable indicia associated with the first ball are displayed on a video screen. The steps of "opening" and "reading" may be repeated for a plurality of balls, and each is displayed, in turn, on the video screen.

The game of chance may be a Bingo game. In such a game, upon a player declaring a win, indicia on a game board of the player are entered into a data storage device, in an embodiment of the disclosed technology, and if the entered data match the plurality of exited balls, the data storage device transmits data to the video screen, indicating a win.

The game of chance may instead be a lottery game. The video screen may be a video screen on a handheld device of a lottery ticket purchaser. Still further, before carrying out the method of playing the game, data corresponding to the lottery ticket of the player may be entered (manually or via a data connection) into the handheld device, and notification of a win may be exhibited to the lottery ticket purchaser on the handheld device in real-time.

In accordance with these objects, and others which will become apparent hereinafter, the disclosed technology will now be described with particular reference to the drawings.

A better understanding of the disclosed technology will be obtained from the following detailed description of the preferred embodiments, taken in conjunction with the drawings and the attached claims.

DETAILED DESCRIPTION OF EMBODIMENTS OF THE DISCLOSED TECHNOLOGY

Embodiments of the disclosed technology provide a method of integrating radio frequency identification (RFID) and near field communication (NFC) to add excitement, features, automation or semi-automation, and digital connectivity to a traditional Bingo or lottery game. Any game of chance may be played using embodiments of the disclosed technology. Balls used for purposes of randomization comprise freely movable RFID tags situated therein. When a ball is chosen, such as when it is the first or only ball to pass through an exit tube of a mixing apparatus, it's RFID tag (with data corresponding to indicia on the ball) is read, and appropriate action can be taken, such as to update a video screen accordingly, check bingos, check lottery winning tickets, and so forth.

Embodiments of the disclosed technology will become clearer in light of the foregoing description of the figures.

Figure 1:
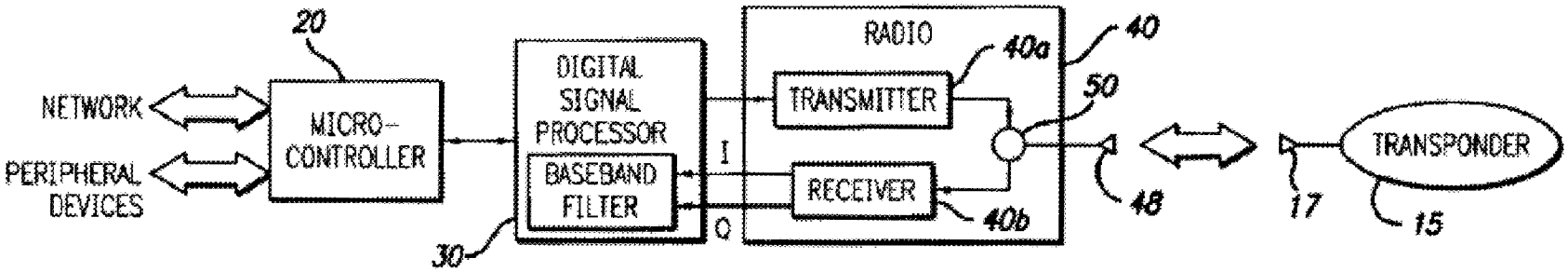
Figure 1 (Prior Art)
FIG. 1 shows a prior art high level drawing of a radio frequency identification (RFID) reader and transponder usable to carry out embodiments of the disclosed technology.

FIG. 1 shows a prior art high level drawing of a radio frequency identification (RFID) reader and transponder usable to carry out embodiments of the disclosed technology. An RFID interrogator 10 and tag 15 in accordance with the disclosed technology are illustrated. The interrogator 10 comprises a microcontroller module 20, a digital signal processor (DSP) module 30, and a radio module 40. The microcontroller module 20 provides control over high level operation of the interrogator 10 and communicates with an external network and peripheral devices. The DSP module 30 provides direct control over all operations of the radio module 40 in response to high level commands provided by the microcontroller module 20, and processes data signals received from the tag 15. The radio module 40 provides for RF communications to/from the tag 15. The tag 15 is disposed in proximity to the interrogator 10, and has an antenna 17 that radiates an RF backscattered signal in response to an RF transmission signal provided by the interrogator. The tag 15 may either be powered from the modulated electromagnetic field provided by the interrogator 10, or may contain its own internal power source, such as a battery.

More particularly, the radio module 40 further comprises a transmitter portion 40*a*, a receiver portion 40*b*, a hybrid 50, and an antenna 48. The hybrid 50 may further comprise a circulator. The transmitter portion 40*a* includes a local oscillator that generates an RF carrier frequency. The transmitter portion 40*a* sends a transmission signal modulated by the RF carrier frequency to the hybrid 50, which in turn passes the signal to the antenna 48. The antenna 48 broadcasts the modulated signal and captures signals radiated by the tag 15. The antenna 48 then passes the captured signals back to the hybrid 50, which forwards the signals to the receiver portion 40*b*. The receiver portion 40*b* mixes the captured signals with the RF carrier frequency generated by the local oscillator to directly down-convert the captured signals to a baseband information signal. The baseband information signal comprises two components in quadrature, referred to as the I (in phase with respect to the transmitted carrier) and the Q (quadrature, 90 degree out of phase with respect to the carrier) signals. The hybrid 50 connects the transmitter 40*a* and receiver 40*b* portions to the antenna 48 while isolating them from each other. In particular, the hybrid 50 allows the antenna 48 to send out a strong signal from the transmitter portion 40*a* while simultaneously receiving a weak backscattered signal reflected from the transponder 15.

Figure 2:
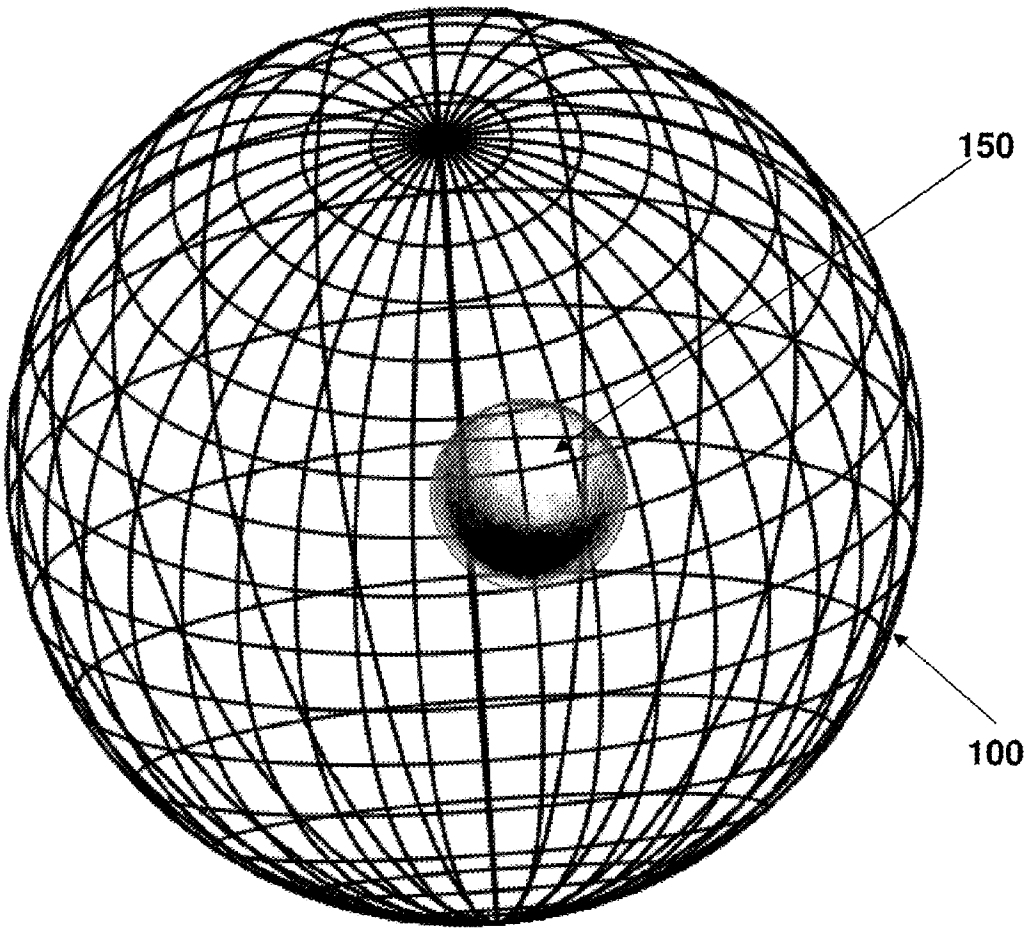
FIG. 2 shows a wireframe version of a ball used in embodiments of the disclosed technology.

FIG. 2 shows a wireframe version of a ball used in embodiments of the disclosed technology. While a wireframe ball may be used in embodiments of the disclosed technology, it is shown here for purposes of clarity. The ball 100 may be a ping pong ball, a plastic ball, a wood ball, a rubber ball, or any other type of ball or even an oblique, cubical, or other structure. In general, gaming laws in various states in the United States require items used in games of chance, such as Bingo, to be "essentially equal as to size, shape, weight and balance and as to all other characteristics that may control their selection." As such, in embodiments of the disclosed technology any ball or other device which meets these criteria can be used.

Further, placed within a hollow interior space of such a ball or other structure (herein simply referred to as a "ball") is an RFID transponder 150, such as a transponder 15, as described with reference to FIG. 1. The transponder 150 is typically non-self-powered and responds to an RFID reader/transmitter. The transponder 150 may comprise a read-only area and read-write area. As such, for example, the ball number may be inscribed in a read-only area, but a game number may be inscribed in the read-write area. Thus, for example, tampering can be detected because the read-only area will have a ball number that matches (or can be read, and is interpreted by, a system of the disclosed technology) the ball number printed on the outside of the ball. However, in the writable area, before each game, the balls may pass one by one past an RFID reader/writer where a game code or operator control number is written thereon. For example, an operator may have a state license identification number of MJF30 and this may be the fifth game on the day of Dec. 1, 2010, so the code "MJF30-5-20101201" may be written to each ball. As will be described with reference to later figures, when a ball is selected at random, the RFID code is read, and this code, in addition to the ball number can be read as further verification that the correct ball was chosen and that it was previously properly authenticated (such as by a gaming commission member working for the state or a person operating a private Bingo game).

Each transponder 150 of each ball, in order to meet regulations, is similar (within an acceptable tolerance level as set by each state) in weight, size, appearance, and so forth. Thus, all balls 100 having a transponder 150 are essentially (within an acceptable tolerance level as set by each state) identical, or are identical in the eyes of a gaming commission or average player. The transponder 150, which may freely move about the interior space of the ball 100, further acts to modify the typical rolling of a hollow ball. When the ball is moved, the transponder falls to the gravitational bottom of the ball. Thus, a ball 100 will stop in place as it quickly loses momentum. This prevents balls from getting lost, as the roll is usually no more than a few inches or feet, compared to an infinitely long roll of an empty ball, save for friction. As a ball 100 rolls with a transponder 150 therein, the transponder 150 is constantly working against the centrifugal motion of the ball, causing it to stop quickly. Further, this has important implications for efficient reading of data on the transponder 150, as will be described with reference to the foregoing figures.

Figure 4:
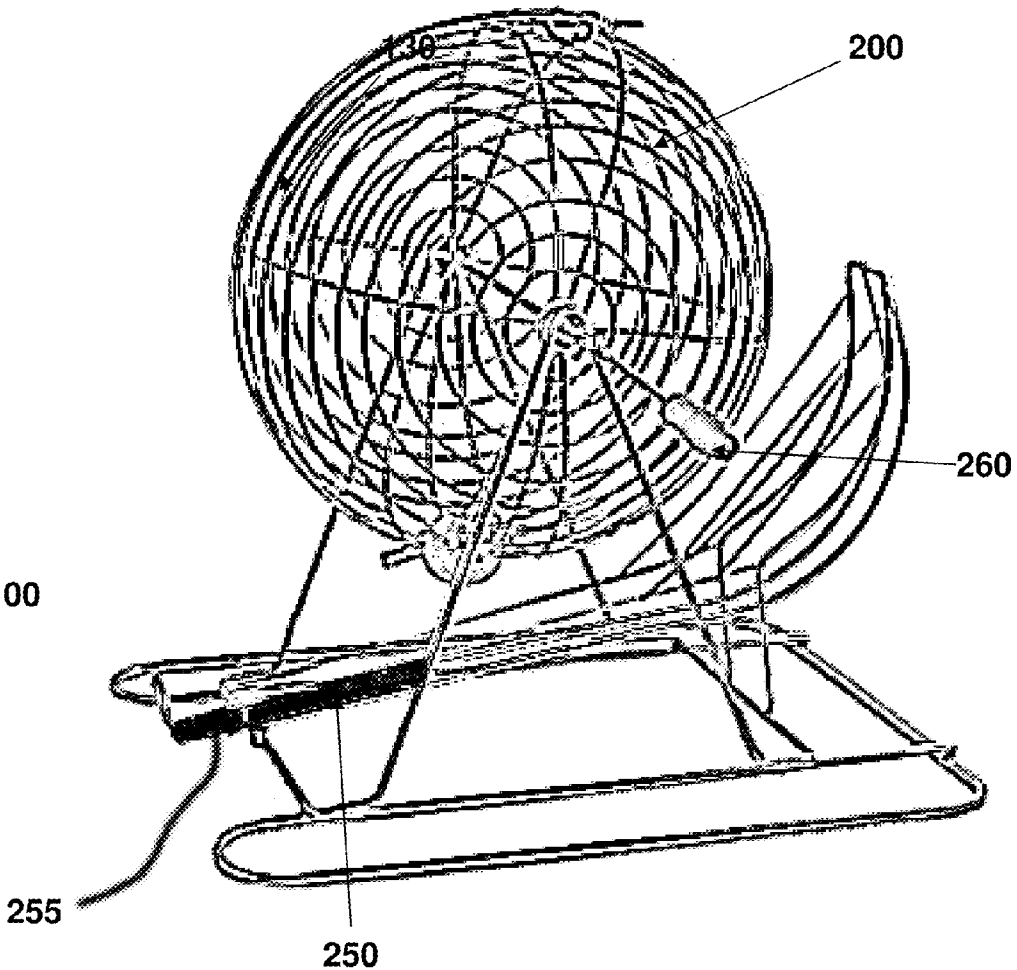
FIG. 4 shows an RFID-modified rotatable chamber mixing apparatus used to carry out embodiments of the disclosed technology.
Figure 3:
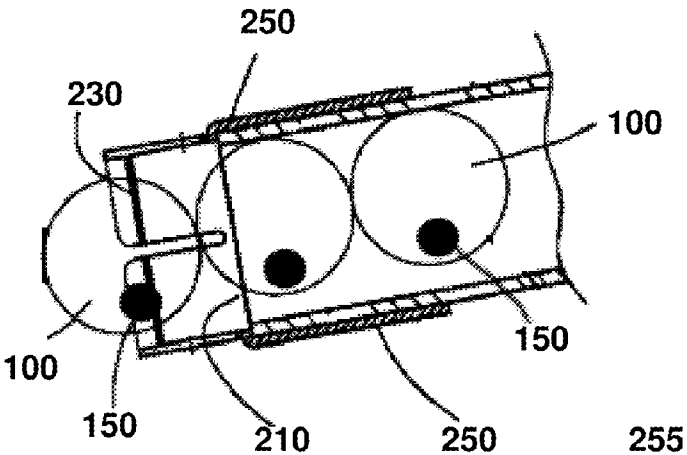
FIG. 3 shows a side perspective view of an exit tube used in an embodiment of the disclosed technology.

FIG. 3 shows a side perspective view of an exit tube used in an embodiment of the disclosed technology. FIG. 4 shows an RFID-modified rotatable chamber mixing apparatus used to carry out embodiments of the disclosed technology. Referring to both figures simultaneously, FIG. 4 comprises a rotatable chamber 200 where balls, such as a plurality of balls 100, are placed. The chamber is rotated by way of crank 260. Such rotatable chambers are generally known in the art of randomized gaming; however, in embodiments of the disclosed technology, an exit tube comprises, or has attached thereto, an RFID reader 250 with cable 255 for power or transmission of data. One or more balls 100 go through an exit tube (or channel), as shown in FIG. 3. Each interior transponder 150 falls to the gravitational bottom (such as, towards the center of the earth in many embodiments of the disclosed technology) of its respective ball 100. The RFID reader is placed, at least or only, at the bottom of the exit tube. In this manner, the transponders 150 are extremely close to the RFID reader 250, as they fall to the bottom of each respective ball 100 and are separated only by the spherical housing of a ball and covering over an antenna of the RFID reader. In some cases, an additional layer, a layer of the exit tube, will also be situated between the antenna of an RFID reader 250 and transponder 150. The extremely close proximity of transponders 150 to an antenna of an RFID reader 250 allows for highly accurate reads and low power requirements. (It should be understood that the transponders 150 are not visible to the exterior in embodiments of the disclosed technology, but are shown in the figures to aid in understanding their position relative to the balls 100).

Figure 5:
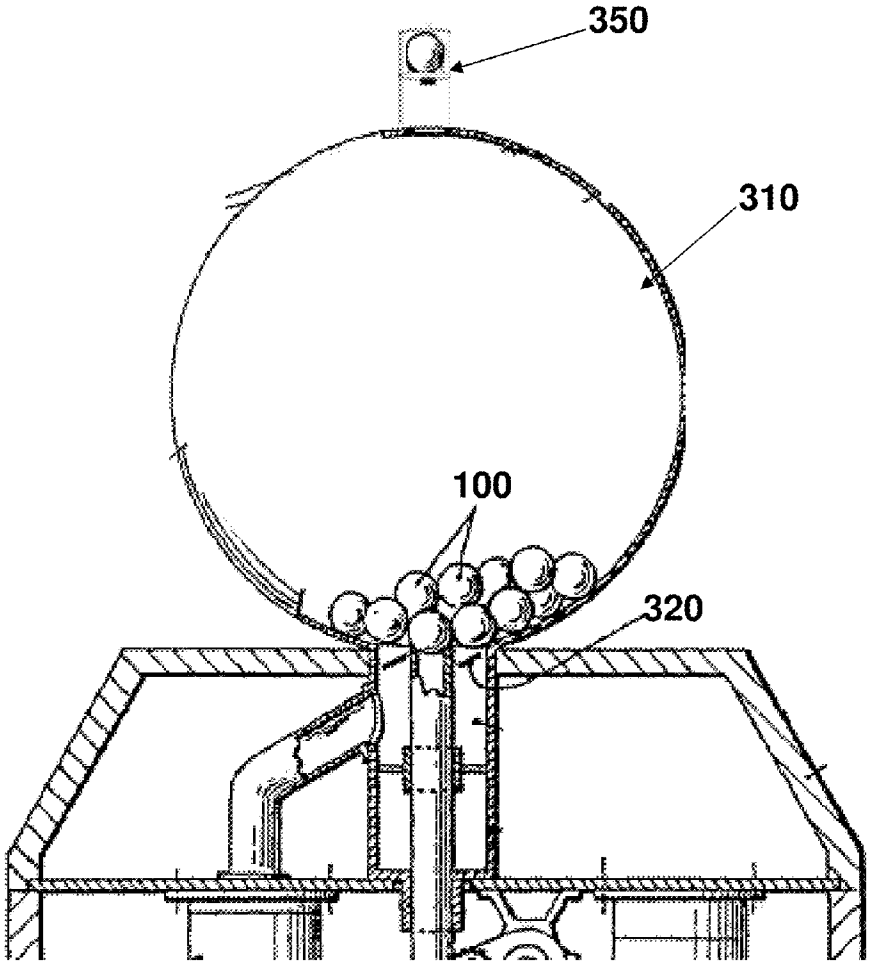
FIG. 5 shows a perspective view of a blower-type mixing apparatus used to carry out embodiments of the disclosed technology.

FIG. 5 shows a perspective view of a blower-type mixing apparatus used to carry out embodiments of the disclosed technology. Such blower-type mixing apparatuses are described, for example, in U.S. Pat. No. 4,961,578 to Chateau, which is hereby incorporated by reference. The blowers, often used in state lotteries, function by providing a jet or jets of air which emanate from portals 320 into a hollow housing 310. Balls 100 placed in the hollow housing 310 are blown around, and one ball at a time fits through an exit tube 350. The exit tube may be closed or sealed off as soon as a ball passes through. While in the prior art, this is done mechanically, in embodiments of the disclosed technology, this can also be accomplished or aided by way of RFID communication. Once a return signal from an RFID transponder is strong enough, that is above a certain pre-defined threshold, it may be determined that a ball has reached within a certain proximity or distance from the reader. When this distance and signal strength is calibrated such that signal strength indicates a position of a ball above, past, or at a position of a valve (such as valve 210 of FIG. 3, or 410 of FIGS. 6 and 7), the valve is closed such that no more than one ball passes through. This concept is further described with respect to FIGS. 6 and 7 below.

Figure 7:
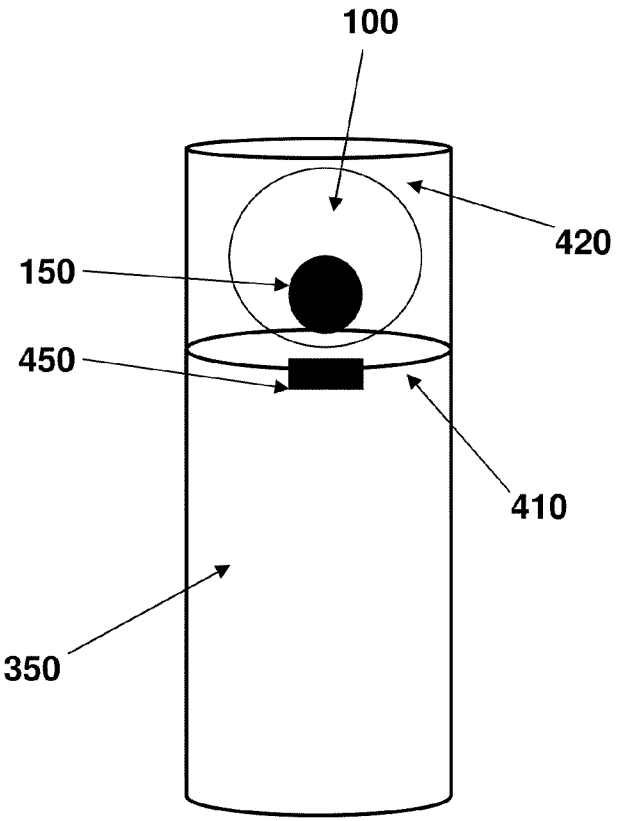
FIG. 7 shows a perspective view of an exit-tube with bottom-mounted RFID reader used to carry out embodiments of the disclosed technology, such as used with the blower-type mixing apparatus of FIG. 5.
Figure 6:
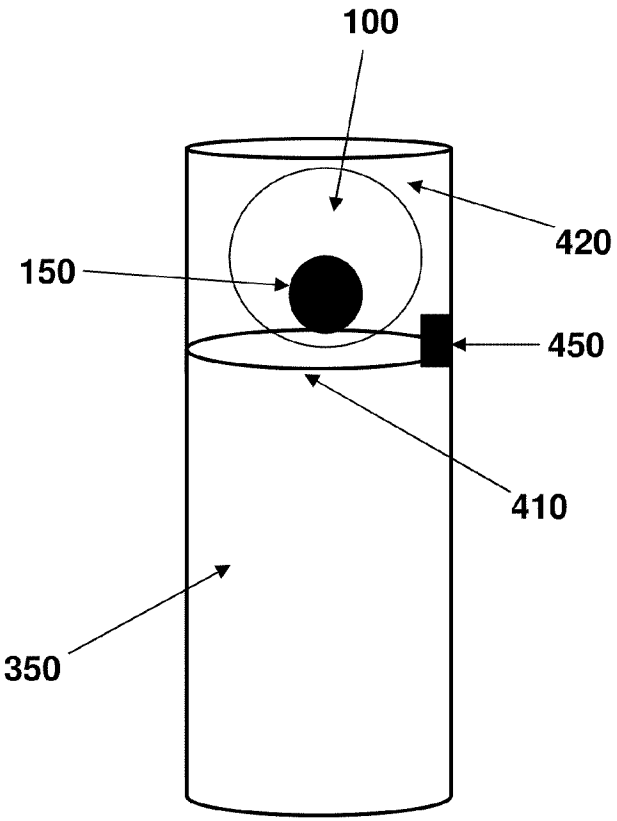
FIG. 6 shows a perspective view of an exit-tube with side-mounted RFID reader used to carry out embodiments of the disclosed technology, such as used with the blower-type mixing apparatus of FIG. 5.

FIG. 6 shows a perspective view of an exit-tube with side-mounted RFID reader used to carry out embodiments of the disclosed technology, such as used with the blower-type mixing apparatus of FIG. 5. FIG. 7 shows a perspective view of an exit-tube with bottom-mounted RFID reader used to carry out embodiments of the disclosed technology, such as used with the blower-type mixing apparatus of FIG. 5. Such exit tubes are shown with an entrance at the bottom of the slide and exit at the top of the slide. This may be the actual orientation of the exit tube, or any other orientation, rotated around, and a 360 degree plane may be used. A valve or gate 410 prevents passage of more than one ball 100, and an RFID reader 450 is situated near the resting position of a transponder 150. In this manner, the RFID reader 450 is positioned, such as shown in FIGS. 6 and 7, close to the transponder which falls to the gravitational bottom of a respective ball 100.

The exit tube portion 420 may be, for example, not much greater than the height of the balls used (such as up to 100% greater in height) or may extend for a far greater length, may curve, or the like. With a longer exit tube, two RFID readers may be used. The first may be placed at the entrance to the exit tube (just above or at the gate 410) and the second at or near a far end of an elongated, or curved and elongated, exit tube. The first RFID reader is used to detect when a ball enters the exit tube by way of receiving a response from an RFID transponder 150 (such as a response comprising encoded data or interference above a pre-defined threshold). Upon such detection, the gate 410 is closed to prevent escape of another ball until an operator of the game is ready for another ball (if ever, during the game). The second RFID reader is then used when the ball is in a stationary position at the end of an exit tube 420 to get an accurate reading of the RFID data on the transponder of the ball, such as the ball number or ball data corresponding to indicia printed on the outside of the ball and authentication data stored on a transponder. In other embodiments, both RFID readers are at or near the valve.

Referring still to FIGS. 6 and 7, in the embodiments shown, the balls enter from the gravitational bottom (at the bottom of the figures), pass valve/gate 410 and sit above the gate. Such an embodiment is used, for example, with the blower-type mixing apparatus shown in FIG. 5. In this embodiment, a ball is blown upwards into the exit tube. The valve may be a one way valve, allowing the ball to pass into the exit tube, but not back down. From there, the ball is read by the RFID reader 450 (either situated at the bottom side, as in FIG. 6, or the bottom middle, as in FIG. 7, or any other location near or in the exit tube). From there, the ball 100 can be lifted out of the exit tube 350/420 (or any other exit tube) and placed into a ball holder. For example, in Bingo games known in the art, a large wooden tray with spaces for each numbered ball is used to track which balls have been selected. An RFID reader might read an RFID tag of a ball 100 and determine which slot the ball should be placed in, or serve as verification to ensure that the person moving the ball to the slot has placed it correctly.

Figure 8:
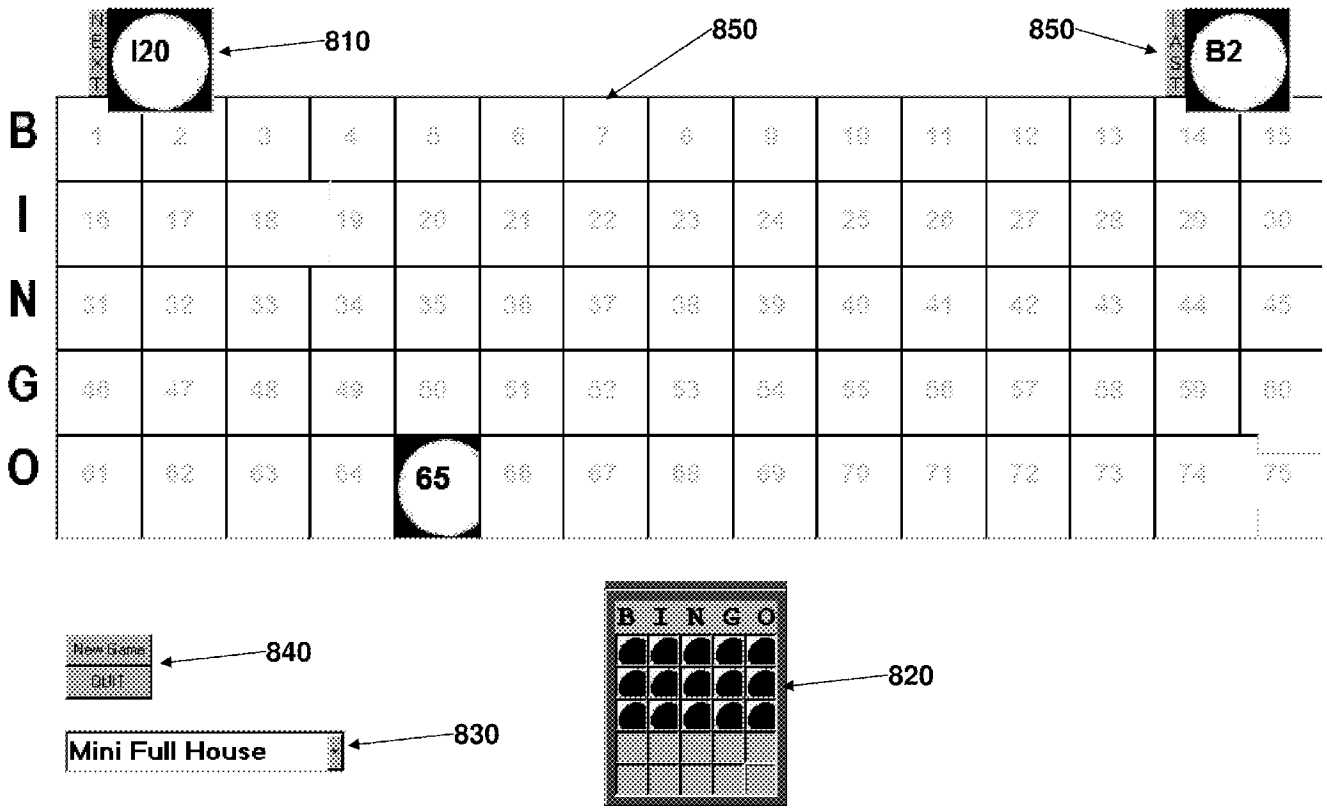
FIG. 8 shows an exemplary image displayed on a video screen in embodiments of the disclosed technology.

FIG. 8 shows an exemplary image displayed on a video screen in embodiments of the disclosed technology. Such a display, in embodiments of the disclosed technology, is linked to an RFID reader, such as RFID reader 450. Upon a ball being selected by/exiting from a mixing apparatus or other physical-motion random number generator, it is displayed in a next box 810. This informs players what number was just chosen. Then, or simultaneously, an indicator is placed on a number board 850. In this case, number 65 in the "O" column is lit up, as having been previously selected. The number chosen just prior is displayed in a last box 850, in this case, "B2" (which should be lit up on the game board as well). Bingo board 820 shows viewers what configuration they need on their Bingo card to win this particular game, and a selector 830 allows an administrator of the Bingo game to choose which game is played, just as buttons 840 allow configuration options for the game by the administrator. Any combination of these displays may be exhibited in embodiments of the disclosed technology.

The video display may be on a TV or other video screen, for example, in a video hall. Further, the video display, or any parts thereof, may be on a person's personal video screen, such as a cellular phone, tablet PC, desktop computer, or the like. This allows users to play the same game remotely, such that if a regular Bingo player is sick, the game can be brought to the player's home. The players may receive such video information by a packet-switched network (e.g., the internet), TV broadcast, or the like. Text messages may be sent indicating the next ball chosen. A message may be in real-time (that is, as soon as a ball transponder 150 is read by an RFID reader, as described above, and in some cases, also verified for authenticity, either automatically or by a manual indication by a person thereof). Such a message may be sent for each ball 100 selected or only upon a win, such as in the case of a lottery game. For example, a lottery game may be televised and, as a person is watching the numbers drawn, notifications can be sent to a lottery ticket purchaser, and upon a win, such a notification may also (or instead) be sent to a winner, indicating the winning amount and redemption of winning instructions. This adds excitement to the games.

In the case of Bingo, the cards may be traditional cards (that is, the actual method of playing is unaltered for the player from that of traditional Bingo). In other embodiments, they are "digital" or "virtual" cards displayed on a video screen (or audio equivalent for the visually impaired), allowing a person to select a spot on his/her game card that was selected with a random number generating apparatus, such as a blower or rotating chamber described above. Or, a hybrid card may be used which is a physical card with a plurality of sensors or NFC readers storing data indicative of which spots, and corresponding numbers, have been selected by the player. Such data can then be transferred digitally (such by NFC/RFID) to a device operated by an administrator of the Bingo game (or any other game of chance). In this manner, verification of a winning Bingo card can be checked against the numbers selected in an automated (computer process) or semi-automated (computer process+human checking of selected numbers vs. numbers on a game card) method. Or, a card number can simply be inputted into a device which stores the numbers that have been chosen in the game of Bingo thus far, and based on a pre-populated database of cards, it can be determined if that card is a winner. In the reverse, such a device which has a pre-populated database of cards and a list of selected balls 100 (received by way of NFC, as described in the above figures) may indicate when a win has occurred, or should be occurring. (It is possible for players to make mistakes and not claim their win.) Thus, if a player calls "Bingo!" before the system indicates that a win is possible, time need not be taken to verify the "Bingo" because such a claim is invalid.

Figure 9:
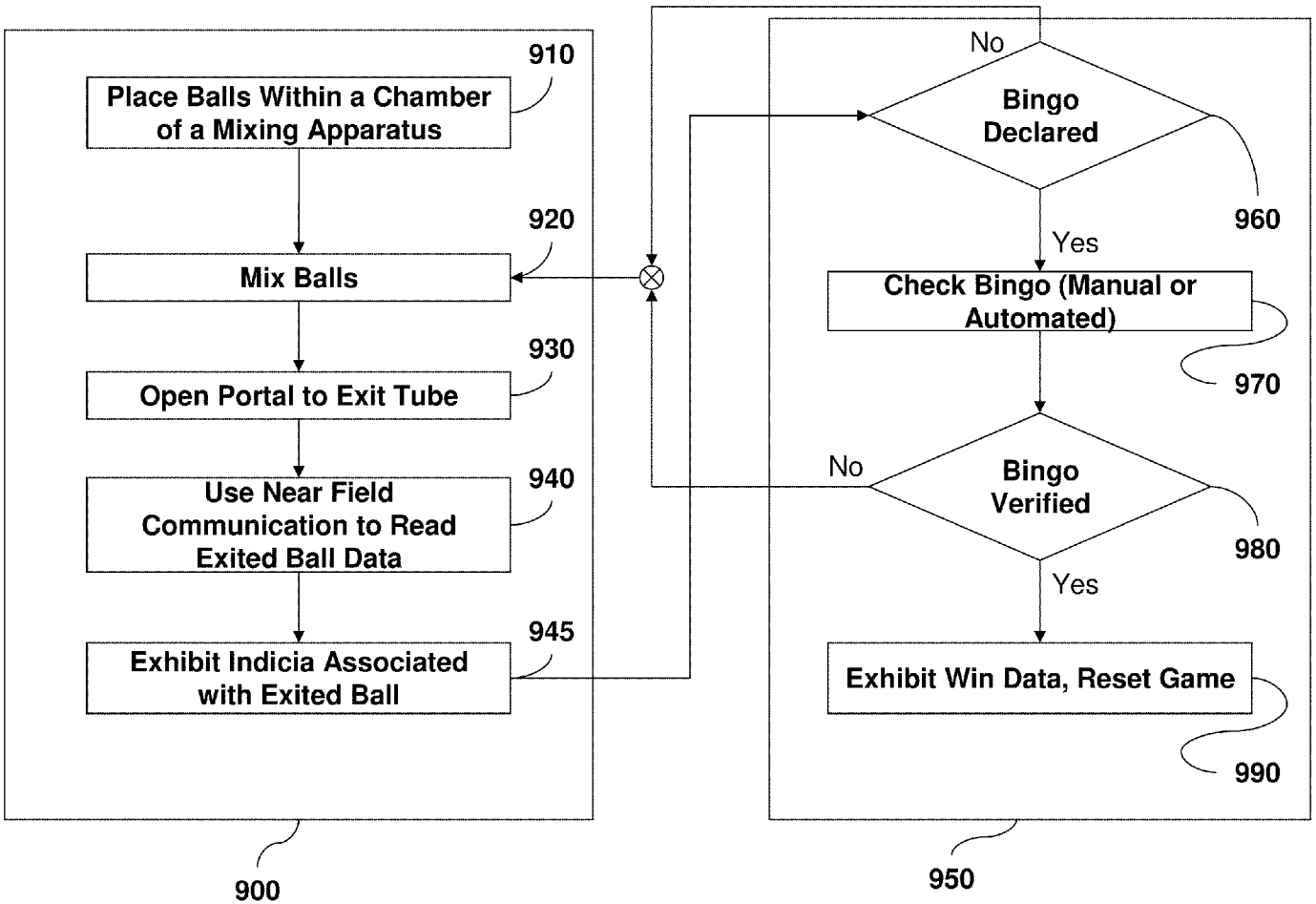
FIG. 9 shows steps taken in a method of carrying out a Bingo game in embodiments of the disclosed technology.

FIG. 9 shows steps taken in a method of carrying out a bingo game in embodiments of the disclosed technology. Box 900 comprises steps carried out in selecting and verifying a randomly selected ball. Box 950 comprises steps carried out to determine if a win state has been reached. In step 910, balls are placed within a chamber of a mixing apparatus, such as those shown in FIGS. 4 and 5. The balls are the type shown in FIG. 2, or other similar balls with transponders capable of near field communication. In step 920, the balls are mixed to ensure randomization of a selection. A portal to an exit tube is then opened in step 930 (or may be previously or always open). Using near field communication, in step 940, when a ball exits, data stored on the transponder (e.g., transponder 150) is read. These data may be verified as being accurate, such as by way of comparing them to pre-entered or written authenticity data or comparing the data read to the indicia painted on the ball. Then, in step 945, indicia associated with the exited ball are exhibited, such as to a video screen. The video screen may be a video screen or a plurality of video screens in a Bingo hall, a television, a cellular phone or personal digital assistant, a combination thereof, etc.

Step 960 is contingent upon a Bingo being declared. If no Bingo is declared, step 920 is returned to (or continued,) whereby balls are mixed and another is selected. As described above, in an embodiment of the disclosed technology, a Bingo declaration may be made by a computing device of an administrator (someone who is facilitating or operating the Bingo game) based on prior knowledge of which Bingo cards are being used and locations of the numbers on the cards, as well as the sequence on the card required for a win. Once a Bingo is declared, step 970 is carried out, which may be any combination of manual or automatic checking. In the most manual form of checking, an administrator of the Bingo game reads off the numbers on the Bingo card of the declared winner and they are compared to the actual balls which have exited the mixing chamber and were previously called out (or displayed) as selected numbers. In the most automated method of checking, the Bingo card configuration by a computing device also receiving inputs of numbers selected (manually entered by an administrator of the game or via digital communication directly or indirectly with the RFID readers associated with the mixing apparatus), to determine a winner. A Bingo card of a winner may light up automatically, upon a win. In a more intermediate version of verification, a person calls a "Bingo" and reads off his/her numbers which an administrator of the game then enters into a computational device to compare read-off numbers to the actually selected numbers during the game.

In any of the above cases, if the Bingo is not verifiable, then step 920 is carried out and the game continues until another "Bingo" is declared. Once a "Bingo" is verified, win data are exhibited (e.g., the winner's card is shown on the video screen or the administrator acknowledges the win) and the game can be reset, so as to enable playing another.

Figure 10:
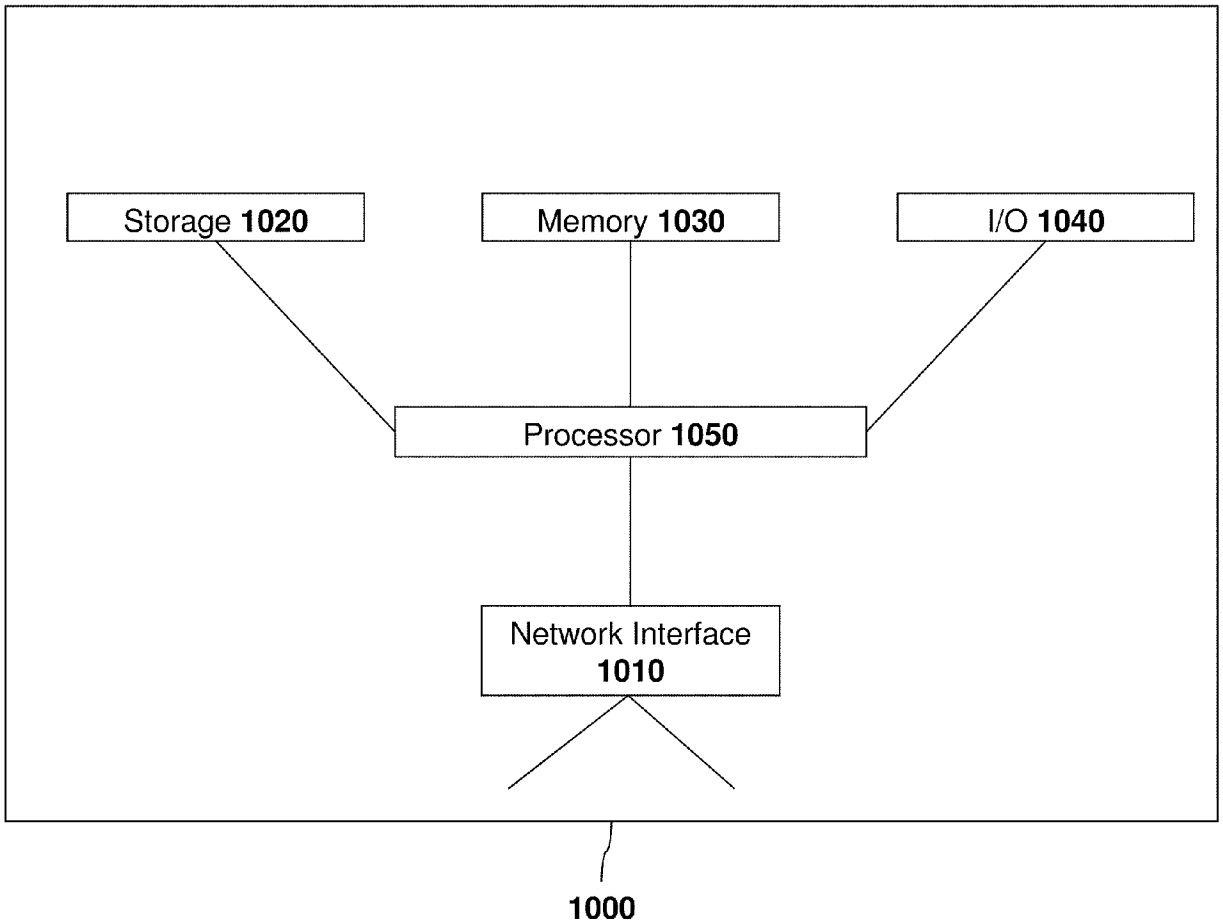
FIG. 10 shows a high level block diagram of devices which may be used to carry out embodiments of the disclosed technology.

FIG. 10 shows a high-level block diagram of a data storage medium device that may be used to carry out the disclosed technology. Device 1000 comprises a processor 1050 that controls the overall operation of the computer by executing the device's program instructions which define such operation. The device's program instructions may be stored in a storage device 1020 (e.g., magnetic disk, database) and loaded into memory 1030 when execution of the console's program instructions is desired. Thus, the device's operation will be defined by the device's program instructions stored in memory 1030 and/or storage 1020, and the console will be controlled by processor 1050 executing the console's program instructions. A device 1000 also includes one or a plurality of input network interfaces for communicating with other devices via a network (e.g., the internet). The device 1000 further includes an electrical input interface for receiving power and data from a power or RFID source. A device 1000 also includes one or more output network interfaces 1010 for communicating with other devices. Device 1000 also includes input/output 1040 representing devices which allow for user interaction with a computer (e.g., display, keyboard, mouse, speakers, buttons, etc.). One skilled in the art will recognize that an implementation of an actual device will contain other components as well, and that FIG. 10 is a high level representation of some of the components of such a device for illustrative purposes. It should also be understood by one skilled in the art that the method and devices depicted in FIGS. 1 through 9 may be implemented on a device such as is shown in FIG. 10.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

I claim:

1. A randomized ball selector comprising:

a video screen;

a chamber comprising an exit tube;

a plurality of balls in said chamber, each single ball comprising a hollow interior with a freely moving radio frequency identification tag therein, said radio frequency identification tag having unique indicia stored thereon;

a mixing apparatus adapted for mixing a said plurality of balls within said chamber; and a near field communication reader in said exit tube; wherein upon exit of a single ball of said plurality of balls into said exit tube, said radio frequency identification tag transmits data corresponding to said unique indicia stored therein, said near field communication reader reads said unique indicia of said single ball and said video screen exhibits a display corresponding to said unique indicia of said single ball.

2. The randomized ball selector of claim 1, wherein:

said mixing apparatus is a blower, said exit tube extends above said chamber, said near field communication reader is situated below said exit tube; and said radio frequency identification tag of said single ball drops to a bottom of said single ball in said exit tube.

3. The randomized ball selector of claim 1, wherein said mixing apparatus mixes by way of rotation of said chamber.

4. The randomized ball selector of claim 1, wherein said randomized ball selector is used for a game of Bingo or state lottery.

5. The randomized ball selector of claim 4, wherein:

said randomized ball selector is used for Bingo;

said near field communication reader reads a plurality of unique indicia;

said unique indicia are electrically stored on a memory storage device, and upon a player of a said game declaring a win, indicia corresponding to a game card of said player are inputted into a computer device.

6. The randomized ball selector of claim 5, wherein said computer device exhibits indicia on said video screen confirming a win when a memory storage device comprises said inputted indicia.

7. The randomized ball selector of claim 6, wherein said indicia corresponding to a game card comprise a unique identifier of said game card, and a win is determined based on said unique identifier of said game card and said unique indicia.

8. The randomized ball selector of claim 6, wherein said inputting is by way of manual input by an operator of said Bingo game.

9. The randomized ball selector of claim 1, wherein said video screen is a remote video screen over one mile from a location of said randomized ball selector and operators of said Bingo game.

10. A plurality of balls usable for a ball selector, each ball of said plurality of balls comprising:

a generally spherical encasement with a hollow interior;

human-readable indicia on said spherical encasement; and a radio frequency identification tag freely movable within said hollow interior and adapted to transmit data corresponding to said human-readable indicia.

11. The plurality of balls of claim 10, wherein said radio frequency identification tag is freely movable within said hollow interior and drops to the gravitational bottom of said hollow interior when said ball is stationary.

12. The plurality of balls of claim 11, wherein said ball selector comprises a near field communication reader below an exit tube above a resting location for said stationary holding of a ball of said plurality of balls.

13. The plurality of balls of claim 12, wherein upon said near field communication reader reading indicia stored in a said radio frequency identification tag of a said ball, said human-readable indicia are displayed on a video screen.

14. A method of playing a game of chance comprising:

placing a plurality of balls within a chamber of a mixing apparatus, each ball of said plurality of balls comprising a hollow interior with a freely moving radio frequency identification tag therein said radio frequency identification tag having unique indicia stored therein;

while mixing said plurality of balls in said chamber, opening access to an exit tube at least until a first ball of said plurality of balls exits through said tube;

providing a near field communication reader in said exit tube;

receiving and reading data from a said radio frequency identification tag of said first ball;

exhibiting on a video screen human-readable indicia associated with said first ball.

15. The method of playing a game of chance of claim 14, wherein said steps of opening and reading are repeated for a plurality of exited balls.

16. The method of playing a game of chance of claim 15, wherein said game is Bingo and, upon a player declaring a win, indicia on a game board of said player are entered into a data storage device and if said entered indicia match said plurality of exited balls, said data storage device transmits data to said video screen indicating a win.

17. The method of playing a game of chance of claim 15, wherein said game is a lottery game, and said video screen comprises a video screen on a handheld device of a lottery ticket purchaser.

18. The method of playing a game of chance of claim 17, wherein before said method, data corresponding to said lottery ticket were entered into said handheld device, and notification of a win is exhibited to said lottery ticket purchaser on said handheld device in real-time.

19. The method of playing a game of chance of claim 14, wherein said exit tube comprises a resting position for said first ball, and a near field communication reader is situated directly below said resting position.

* * * * *